United States Patent [19]

Letts

[11] 4,056,882

[45] Nov. 8, 1977

[54] METHOD OF MAKING A DIMENSIONALLY STABLE COMMUTATOR

[75] Inventor: Robert Arthur Letts, Fleet, England

[73] Assignee: Airscrew Howden Limited, England

[21] Appl. No.: 693,675

[22] Filed: June 7, 1976

Related U.S. Application Data

[63] Continuation of Ser. No. 512,395, Oct. 4, 1974, abandoned.

[30] Foreign Application Priority Data

Oct. 5, 1973 United Kingdom ..... 46716/73

[51] Int. Cl.[2] ..... H01R 43/06

[52] U.S. Cl. ..... 29/597; 29/447; 29/452; 310/42; 310/43; 310/235

[58] Field of Search ..... 29/597, 447, 452; 310/233, 235, 236, 237, 42, 43

[56] References Cited

U.S. PATENT DOCUMENTS

| | | | |
|---|---|---|---|
| 1,816,629 | 7/1931 | Worner | 310/235 |
| 2,516,593 | 7/1950 | Rokach | 29/597 |
| 2,606,220 | 8/1952 | Labastie | 29/597 |
| 2,606,221 | 8/1952 | Heintz | 310/236 |
| 3,290,527 | 12/1966 | Habermann | 29/597 |

*Primary Examiner*—Carl E. Hall

*Attorney, Agent, or Firm*—Sughrue, Rothwell, Mion, Zinn & Macpeak

[57] ABSTRACT

This invention describes a method of making a commutator, for a high speed electric machine, (1) embedding a number of conductive bars in insulating plastics material to form a moulded commutator (2) the moulded commutator defining at least one annular seat (3) placing a ring of high tensile material on the seat whereby to stress the ring in tension and thereby apply a radially inward load to each bar which is greater than the centrifugal force on the bar at maximum running speed. The invention also includes a commutator made by this method.

7 Claims, 4 Drawing Figures

METHOD OF MAKING A DIMENSIONALLY STABLE COMMUTATOR

This is a continuation of application Ser. No. 512,395, filed Oct. 4, 1974 now abandoned.

FIELD OF THE INVENTION

This invention relates to methods of making commutators and commutators made by such methods. The invention is more especially concerned with "moulded" commutators that is, commutators comprising a number of conductive bars embedded in an insulating plastics material.

BACKGROUND OF THE INVENTION

In one form of moulded commutator, the bars are retained by being embedded, together with reinforcing rings, in plastics material, which is moulded in position under pressure and fills completely all the available space. By this means, radial movement of the commutator bars under centrifugal load is more uniform than in commutators of built-up construction although such movement will still occur.

The moulded commutator above described gives adequate performance at moderate speeds. However, with present trends towards higher commutator surface speeds the shortcomings of the moulded construction are an embarrassment and even with final machining taking place at the normal running speed of the motor and with the commutator assembly heated to its normal running temperature, minute variations in the final positions of the commutator bars still occur, sufficient to cause rapid brush wear and sparking and consequent radio interference.

The moulded construction is applied to radial commutators as well as to the cylindrical type. The same limitations apply to radial commutators as apply to the cylindrical form.

SUMMARY OF THE INVENTION

The invention provides a method of making a commutator, comprising 1. embedding a number of conductive bars in insulating plastics material to form a moulded commutator
2. the moulded commutator defining at least one annular seat
3. placing a ring of high tensile material on the seat whereby to stress the ring in tension and thereby apply a radially inward load to each bar which is greater than the centrifugal force on the bar at maximum running speed.

This invention also includes a commutator, comprising 1. a number of conductive bars embedded in insulating plastics material to form a moulded commutator
2. the moulded commutator defining at least one annular seat
3. a ring of high tensile material placed on the seat whereby to stress the ring in tension and thereby apply a radially inward load to each bar which is greater than the centrifugal force on the bar at maximum running speed.

Preferably the radially inward load is greater than the centrifugal force by a factor of over 3 but a satisfactory construction may be designed with a lower factor. The ring or rings may be heated and inserted on to their seats while hot, so as on cooling to have the required preload. Alternatively the rings can be press-fitted cold.

The maximum running speed of a motor may be limited in several way e.g. by a permanently coupled load, by electrical design, by strength limitations of materials used, or by instability of current designs of commutators.

By reason of the invention the limitation previously imposed by lack of commutator stability no longer applies.

While the invention includes a cylindrical commutator with a single pre-loaded ring, a construction will often be preferred wherein the bars are formed with recessed ledges at each end, the plastics material forms an annular seat around the recessed ledge at each end, and one pre-loaded ring is located on each seat. If the rings were located at the extreme ends of long bars there might be a tendency for the bars to bow outwardly at the middle. By keeping the bars short and placing the rings inwardly of the ends, this effect can be avoided.

The invention is concerned not only with cylindrical commutators, but contemplates a moulded flat or radial commutator, wherein the bars are formed with circumferential ledges, the plastics material forms an annular seat around the ledges, and a pre-loaded ring is located on the seat.

With a large margin of pre-load over centrifugal load, there will be no radial displacement of the commutator bar at design speed. In fact there will be no radial movement of the commutator bar until such time as the centrifugal load exceeds the pre-load.

This is the condition whereby the surface of the commutator does not expand at running speed and therefore there can be no differential movement between individual commutator bars, and is an ideal condition which cannot quite be realised in practice, because the preloading rings are themselves subject to centrifugal loading and hence radial strain, so that some radial movement of the commutator bars will be allowed. By deliberate design, this radial movement can be limited to negligible proportions by having the maximum ratio possible between the inward pre-load from the rings and outward centrifugal load of the commutator bars and by achieving this maximum ratio with the lightest possible loading ring (i.e. limiting the centrifugal deformation of the pre-loading ring to an insignificant amount, typically less than 2% of pre-load deformation).

BRIEF DESCRIPTION OF THE DRAWINGS

Three embodiments of the invention will now be described by way of example with reference to the accompanying drawings, in which.

DESCRIPTION OF PREFERRED EMBODIMENTS

Figure 1:
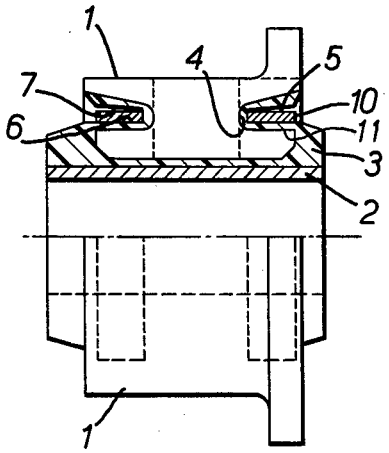
FIG. 1 is a view of a first cylindrical form of commutator, partly in longitudinal section and partly in elevation.

Referring to FIG. 1, the commutator there shown comprises a series of similar copper bars 1 arranged in a ring about a central tube 2. The bars 1 are embedded in phenolic or other suitable plastics material 3 which is moulded around them. Alternatively, for manufacturing convenience, the bars may be spaced apart circumferentially by thin shims of insulating material (e.g. mica) prior to moulding operation. The thin shims and/or moulded material provide a layer of insulating material between individual components of the commutator. The bars 1 each have a deep recess 4 at either end, and the plastics material is moulded into the end recesses to provide an annular groove 5 at each end of the assembly. Each groove has a cylindrical inner annular surface 6 and an inwardly inclined upper annular surface 7. The annular surfaces 6 provide seats for pre-loading rings 10 of high tensile steel which, prior to assembly, in the cold condition, have an interference with the seats. The rings 10 are heated until they can be inserted into position, and on cooling exert a compressive force on the seats. The rings 10 are finally embedded in plastics material 11 which is run into the grooves 5 to fill them.

By way of example, with the proportions shown in FIG. 1, if the steel of the rings 10 has an ultimate tensile stress of 55 tons/in$^2$ and is given a hoop stress of 29 tons/in$^2$ the radially inwards pressure on the commutator bars is 2.99 tons/in$^2$ (i.e. approximately 10% of hoop stress).

Of this pre-load pressure of 2.99 tons/in$^2$ only 1.4% is lost to centrifugal force of the ring itself due to its own mass at a design speed of 13,500 RPM. Expressing this another way, 98.6% of the stress in the pre-loading ring is available for pre-loading the ring of commutator segments when the assembly is running at design speed.

This pre-load pressure of 2.99 − 1.4% = 2.95 tons/in$^2$ is transmitted across a layer of insulating material which has a minimum ultimate compressive stress of 8 tons/in$^2$; i.e. the working pre-load compression is only 37% of the minimum strength of the insulating material.

Similarly the compressive hoop stress in the ring of commutator bars under pre-load is a maximum of 8.97 tons/in$^2$ which is less than half its failing load.

With these moderate stress levels induced by pre-load, large factors of radially inwards pre-load to radially outwards centrifugal load are possible; thus at the large diameter end of the assembly the preload is 2.75 times the centrifugal load, and at the small end of assembly, the pre-load is 4.8 times the centrifugal load.

As radially outwards displacement of the components cannot occur until the centrifugal load exceeds the pre-load, the large margins of pre-load which are possible (175% at one end and 380% at the other) ensure a stable assembly at design speed.

The interference fit of the pre-loading ring necessary to obtain the required stress is in this typical case 0.0032 inches/inch of diameter, and this can be obtained by heating the ring to 340° C. which gives an additional clearance for assembly. Thus no temperatures are involved which would damage materials used.

The central tube 2 is desirable, but not essential. Thus tube is a production convenience as it forms a useful member of the pre-loaded structure and carries a load which would otherwise have to be absorbed by the copper segments. A pre-loaded commutator could be designed with no centre tube present, but the tube, particularly if of steel, is of structural use as well as being desirable for other reasons.

Figure 2:
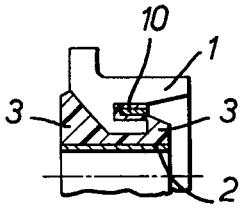
FIG. 2 is a partial longitudinal section of a second cylindrical form of commutator.

FIG. 2 illustrates an alternative design using only a single pre-loading ring. The principles of construction are the same as for the two-ring structure above described.

Figure 3:
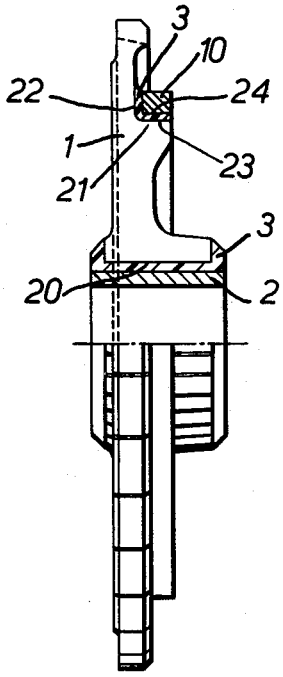
FIG. 3 is a view of a third form of commutator, which is of radial type, the view being partly in longitudinal section and partly in elevation.
Figure 4:
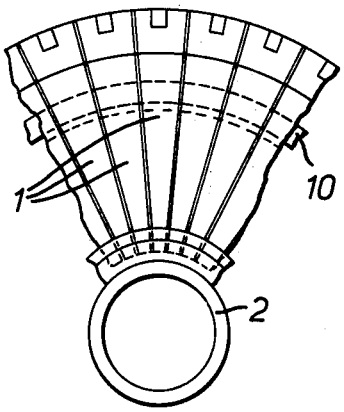
FIG. 4 is a partial front elevation of the third form of commutator.

FIGS. 3 and 4 illustrate a commutator according to the invention which is of radial type, the radially extending commutator bars 1 presenting a flat annular surface. Each bar has a foot 20 at its inner end and a ledge 21 near its outer end. The bars are arranged about an inner tube 2 and resin 3 is moulded around the feet of the bars and between them, so that the bars are mounted in the resin and insulated by it from one another. As in the case of the cylindrical commutator previously described, the bars can be spaced apart circumferentially by shims of insulating material prior to moulding. The resin extends over radial cylindrical faces 22, 23 of the ledges, providing a continuous cylindrical surface 24 on which a pre-loading ring 10 is shrunk. The pre-loading ring 10 of FIGS. 3 and 4 has the same function as that of the construction described earlier and will not need to be discussed further.

What is claimed is:

1. A method of making a high speed commutator, comprising embedding a number of conductive bars in insulating plastics material to form a moulded commutator while simultaneously providing the moulded commutator with at least one annular seat, and then subsequently placing a ring of high tensile material on the seat, stressing the ring in tension and thereby applying a radially inward load to each conductive bar which is three times greater than the centrifugal force on the bar at maximum running speed.

2. A method as claimed in claim 1 wherein the commutator is cylindrical and two annular seats are formed one at either end of the cylinder under the brush-engaging outer surface and wherein one of said rings is located on each seat.

3. A method as claimed in claim 1 wherein a single annular seat is formed on the underside of brush-engaging surfaces of the commutator and a single ring is mounted thereon.

4. A method as claimed in claim 1 wherein each ring is force-fitted on its seat.

5. A method as claimed in claim 1 wherein each ring is heat shrunk on its seat.

6. A method as claimed in claim 1, wherein the bars are disposed about a central tube and the plastics material is molded around the tube as it embeds the bars.

7. A method of making a commutator, comprising 1. embedding a number of conductive bars in insulating plastics material to form a moulded commutator the bars having recesses in their ends which are circumferentially aligned
2. the mouled commutator defining and annular seat at each end within the recesses
3. expanding a ring of high tensile material
4. placing said ring on each seat whereby to stress the ring in tension and thereby apply a radially inward load to each bar which is greater than three times the centrifugal force on the bar at maximum running speed.

* * * * *